US011448989B2

(12) United States Patent
Schneider et al.

(10) Patent No.: US 11,448,989 B2
(45) **Date of Patent: *Sep. 20, 2022**

(54) DETERMINING THICKNESS OF A LAYER OF WET PRINTING FLUID

(71) Applicant: HP INDIGO B.V., Amstelveen (NL)

(72) Inventors: Matan Schneider, Ness Ziona (IL); Fernanda Orlik, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 232 days.

This patent is subject to a terminal disclaimer.

(21) Appl. No.: 16/886,434

(22) Filed: May 28, 2020

(65) Prior Publication Data

US 2020/0292979 A1 Sep. 17, 2020

Related U.S. Application Data

(63) Continuation of application No. 16/097,329, filed as application No. PCT/EP2016/068690 on Aug. 4, 2016, now Pat. No. 10,691,051.

(51) Int. Cl.
*G03G 15/00* (2006.01)
*G03G 15/10* (2006.01)

(52) U.S. Cl.
CPC ..... *G03G 15/5029* (2013.01); *G03G 15/10* (2013.01); *G03G 15/101* (2013.01); *G03G 15/5025* (2013.01); *G03G 15/6558* (2013.01); *G03G 2215/00801* (2013.01)

(58) Field of Classification Search
CPC .. G03G 15/5029; G03G 15/10; G03G 15/101; G03G 15/5025; G03G 15/6558; G03G 2215/00801
See application file for complete search history.

(56) References Cited

U.S. PATENT DOCUMENTS

| | | | |
|---|---|---|---|
| 2,197,823 | A | 4/1940 | Young |
| 3,657,645 | A | 4/1972 | Van Nuten |
| 7,886,590 | B2 | 5/2011 | Sprycha et al. |
| 7,953,332 | B2 | 5/2011 | Jeschonek |
| 8,520,223 | B2 | 8/2013 | Bucher |

(Continued)

FOREIGN PATENT DOCUMENTS

| | | |
|---|---|---|
| JP | 10026644 | 1/1998 |
| JP | 200313091 | 5/2003 |

OTHER PUBLICATIONS

Saad, Ashraf Abd El-Rahman Elsayed. "Environmental pollution reduction by using VOC-free water-based gravure inks and drying them with a new drying system based on dielectric heating." PhD diss., Universität Wuppertal, Fakuität für Elektrotechnik, Informatlonstechnik und Medientechnik» Medientechnik» Dissertationen, 2008.

(Continued)

*Primary Examiner* — Henok D Legesse
(74) *Attorney, Agent, or Firm* — HP Inc. Patent Department

(57) ABSTRACT

A printing apparatus is described in which a guide member biases a printing substrate with a layer of printing fluid toward an electrode array with a plurality of electrodes. Processing circuitry determines a dryness of the layer of printing fluid based on an output of the electrode array when the plurality of electrodes is in electrical contact with the printing substrate.

15 Claims, 5 Drawing Sheets

(56) References Cited

U.S. PATENT DOCUMENTS

| | | | | |
|---|---|---|---|---|
| 10,691,051 | B2 * | 6/2020 | Schneider | G03G 15/5029 |
| 2002/0131058 | A1 | 9/2002 | Luxem | |
| 2003/0133728 | A1 | 7/2003 | Caruthers | |
| 2008/0252680 | A1 | 10/2008 | Schmid et al. | |
| 2009/0035795 | A1 | 2/2009 | Dudenhoefer | |
| 2013/0220158 | A1 | 8/2013 | Vassilev et al. | |
| 2015/0360480 | A1 | 12/2015 | Bugner et al. | |

OTHER PUBLICATIONS

Sugimoto, T., et al., Detection of Paint Curing by Non-contact Surface Resistivity Measurement, 2012, http://www.electrostatics.org/images/ESA2012_L1.pdf.

Water Based Inks for Flexographic Printing, May 17, 2001, http://www.pneac.org/sheets/flexo/waterbasedinks.pdf.

* cited by examiner

DETERMINING THICKNESS OF A LAYER OF WET PRINTING FLUID

CROSS-REFERENCE TO RELATED APPLICATIONS

This application is a continuation of co-pending U.S. application Ser. No. 16/097,329, filed Oct. 29, 2018, which itself is a national stage entry under 35 U.S.C. § 371 of PCT/EP2016/068690, filed Aug. 4, 2016, each of which is incorporated by reference herein in its entirety.

BACKGROUND

Many types of printing devices are known and commonly used, and various printing technologies exist. Some printing technologies use wet printing material, while other use dry printing material. One example of a wet printing material printing technology is liquid electrophotographic printing which uses electrically charged pigment particles suspended in a wetting agent.

BRIEF DESCRIPTION OF THE DRAWINGS

Examples of the disclosure are further described hereinafter with reference to the accompanying drawings, in which.

DETAILED DESCRIPTION

Figure 1:
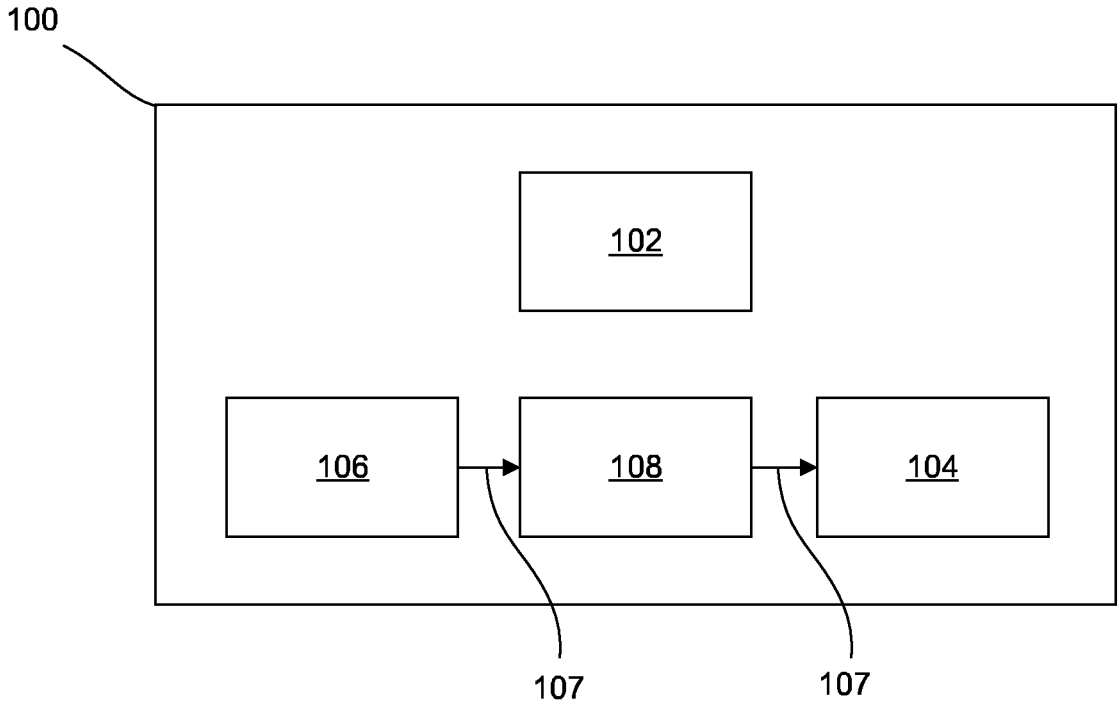
FIG. 1 is a simplified diagram showing an example printing apparatus according to the present disclosure.

The present disclosure provides a printing apparatus and methods of operating the same. The printing apparatus may be referred to as a printing system or a printer, and is to print any combination of images, text and other symbols onto a printing substrate. In the presently described examples, the printed substrate may comprise a fibre-based substrate such as paper or card, and/or may comprise plastics, metals, alloys, or the like. Other printing substrates are also contemplated. The images, text or other symbols may be printed onto the printing substrate by depositing a printing material, such as a printing ink, onto the printing substrate.

In this example, a layer of wet printing fluid in the form of a primer fluid is deposited onto the printing substrate before application of the printing material. The primer fluid may be applied in an inline priming system which may be provided inline in, collocated with, or integrated with a printing system or print engine so as to apply primer fluid to the printing substrate before or during the printing process, such that primed printing substrate may be subsequently printed on by the printing system or print engine.

After application of the primer fluid to the printing substrate, the printing substrate may be referred to as a primed printing substrate. The printing material such as printing liquid in the form of, for example, printing ink may be applied to a primed surface of the primed printing substrate. The use of the primer fluid typically ensures the printing material adheres well to the primed printing substrate.

In some examples, a moisture content of the primed printing substrate may decrease progressively after application of the primer fluid to the printing substrate. The moisture content of the primed printing substrate may be dependent on at least one or more of: a moisture content of the primer fluid prior to application on the printing substrate; a thickness of a layer of primer fluid applied to the printing substrate; the environmental conditions of the printing substrate on and after application of the primer fluid thereon; the environmental conditions of the ambient surroundings of the primed printing substrate; and an amount of time elapsed since application of the primer fluid to the printing substrate.

A printing quality of a printed article may depend on the thickness of the layer of primer fluid on the printing substrate. In some examples, the printing quality of the printed article may depend on the moisture content of the primed printing substrate at the point at which the printing material is applied to the primed printing substrate. After the primer fluid is applied to the substrate, it should be sufficiently dried before being printed on. If the primer fluid is not dry, the primed printing substrate may leave unwanted residue on components of the printing apparatus with which it interfaces during the print process. Furthermore, if the primer fluid is not sufficiently dry, this may prevent printing liquid being successfully applied to the primer surface. A consistent thickness of the layer(s) of primer fluid may provide a good printing quality for the printed article.

Although the description hereinbefore refers to moisture content, the term moisture content may mean the percentage or amount of any liquid (such as a primer liquid) on or in the printing substrate.

The present apparatus and method are to determine the thickness of the layer of primer fluid on the printing substrate. By determining the thickness of the layer of primer fluid on the printing substrate, a predictor for the printing quality of the printed article may be determined. In some examples, the determined thickness of the layer of primer fluid may be used by the printing apparatus to control a primer fluid applicator to alter a future thickness of the layer of primer fluid, whereby to adjust the printing quality of the printed article.

The wet printing fluid may be any primer fluid comprising a solvent, for example a water-based primer fluid. The solvent may be any solvent where a printing substrate having the primer fluid comprising the solvent applied thereon exhibits a resistance or conductivity based on the amount of solvent remaining on the printing substrate. The printing material may be any printing ink compatible with the specific printing substrate and the primer fluid, for example a water-based ink or a UV water-based ink.

FIG. 1 is a simplified diagram showing an example of printing apparatus 100 according to the present disclosure. The printing apparatus 100 comprises a feed mechanism 102 to move a printing substrate through the printing apparatus 100. The printing apparatus 100 comprises a printer 104 to deposit a printing material onto a surface of the printing substrate as the printing substrate is moved through or past the printer 104 by the feed mechanism 102. The printing apparatus 100 comprises a primer applicator 106 to apply a primer fluid to the printing substrate as the printing substrate is moved through or past the primer applicator 106 by the feed mechanism 102. The primer applicator 106 is positioned upstream of the printer 104, such that a surface of the printing substrate is primed by the primer fluid from the primer applicator 106 prior to deposition of the printing material thereon by the printer 104. In the examples disclosed herein, the printing apparatus 100 also comprises a primer thickness determination module 108 to determine a thickness of one or more layers of primer fluid on the printing substrate as the printing substrate is moved through or past the primer thickness determination module 108 by the feed mechanism 102. The primer thickness determination module 108 is positioned between the primer applicator 106 and the printer 104 in order to measure the thickness of the layer(s) of primer fluid on the printing substrate prior to deposition of the printing material onto the surface of the printing substrate by the printer 104. Arrows 107 are representative of a direction of travel of the printing substrate through the printing apparatus 100, as described previously.

The feed mechanism 102 may comprise one or more rollers. The rollers may provide for a frictional contact between the roller and a surface of the printing substrate. Thus, driven movement of the rollers may move the printing substrate through the printing apparatus 100. In some examples, the feed mechanism 102 is provided before the primer applicator 106 and is operable to push the printing substrate through the printing apparatus 100. In an example, the feed mechanism 102 is provided after the printer 104 and is operable to draw the printing substrate through the printing apparatus 100. The feed mechanism 102 may be provided sufficiently far after the printer 104 to allow the printing fluid, such as printing ink, to be sufficiently dry as not to be deposited on components of the feed mechanism 102. In examples, the feed mechanism 102 is in contact with an opposite surface of the printing substrate to the surface to be primed and/or the surface to be printed. This may avoid deposition of the printing fluid, such as printing ink, onto the components of the feed mechanism 102. In some examples, the feed mechanism may be provided both before the primer applicator 106 and after the printer 104. The feed mechanism 102 may comprise further components such as guide members or rollers to provide for smooth operation of the print apparatus 100 and to avoid jamming of the print apparatus 100.

The printer 104 may be any suitable print engine capable of depositing a printing material onto the printing substrate whereby to form text, images or symbols (or any other desired coating or pattern) on the substrate. In some examples, the print apparatus 100 including the primer thickness determination module 108 may be standalone from the printer 104.

The primer applicator 106 may be any suitable applicator capable of depositing a printing fluid such as a primer fluid onto the printing substrate whereby to prime at least one surface of the printing substrate. The primer applicator 106 may be operable to vary an amount of primer fluid applied to the printing substrate. In examples, the amount of primer fluid applied to the printing substrate may be varied by controlling other components of the printing apparatus, for example by varying a speed of movement of the printing substrate past or through the primer applicator 106 using the feed mechanism 102. In some examples, the print apparatus 100 including the primer thickness determination module 108 may be standalone from the primer applicator 106.

The primer thickness determination module 108 will be described in more detail with reference to FIGS. 2 to 6 below.

In some examples, the printing apparatus 100 may also include a dryer (not shown) between the primer applicator 106 and the printer 104 in order to dry the layer(s) of primer fluid on the printing substrate prior to deposition of the printing material onto the surface of the printing substrate by the printer 104. The dryer may be positioned before or after the primer thickness determination module 108. In some examples, the dryer may be controlled to increase or decrease an amount of drying based on an output of the primer thickness determination module 108.

Figure 2:
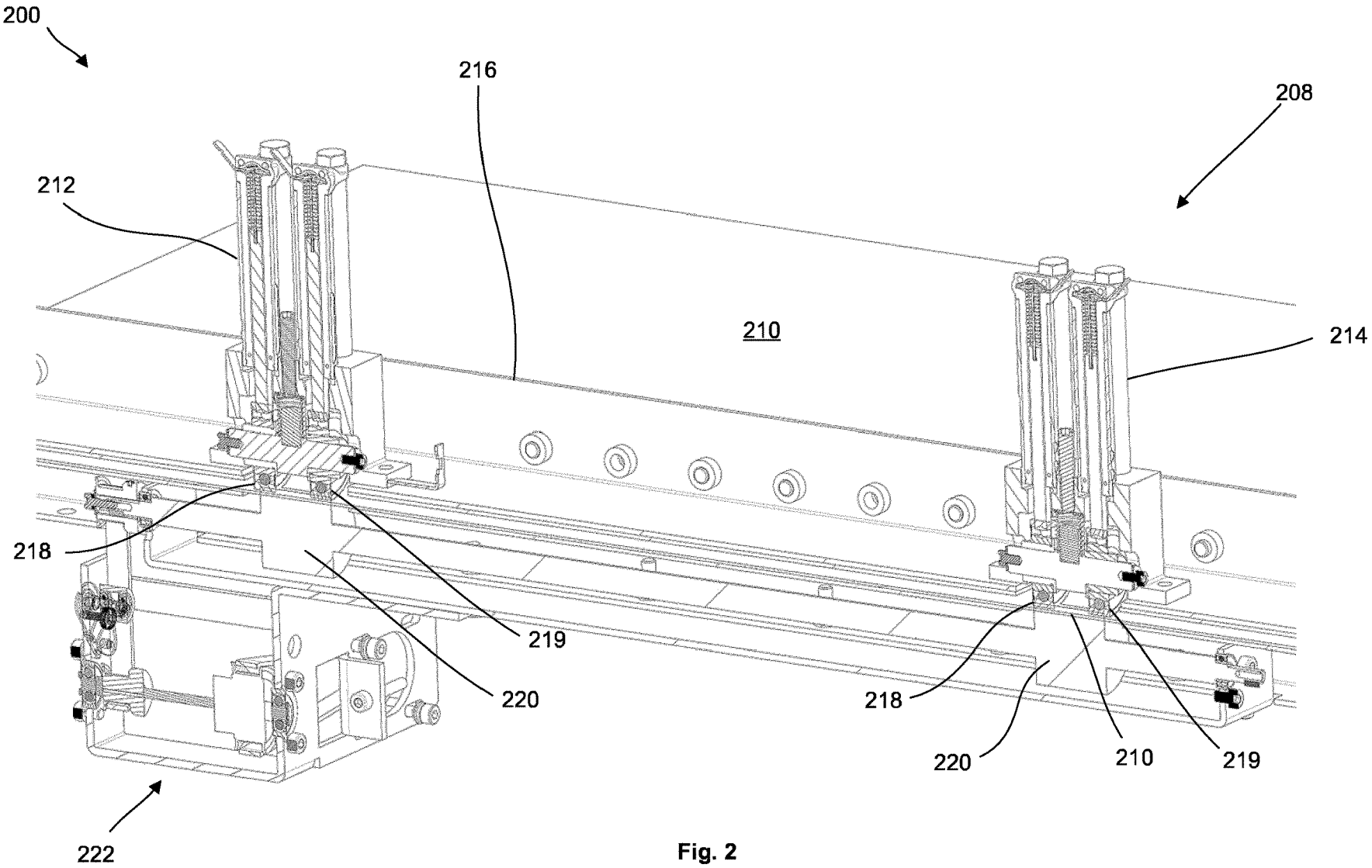
FIG. 2 shows a cross-section through an example printing apparatus according to the present disclosure.

FIG. 2 shows an example of a cross-section through a printing apparatus according to the present disclosure. The printing apparatus 200 comprises a primer thickness determination module 208 to measure a thickness of a layer of primer fluid on a primed printing substrate 210. The primer thickness determination module 208 comprises a first electrode array 212 and a second electrode array 214. Each electrode array 212, 214 is supported adjacent to the printing substrate 210 by a support member in the form of an angle member 216. Each electrode array 212, 214 comprises a first electrode 218 and a second electrode 219. The first electrode 218 and the second electrode 219 may be mutually spaced by any suitable distance, providing a resistance therebetween may be measured. In examples, the distance may be between 1 millimetre and 20 millimetres. Thus, an electrical current may be passed between the first electrode 218 and the second electrode 219 across a surface of the printing substrate 210 to determine a surface resistance of the printing substrate 210 (and any layers of primer fluid provided thereon) in a region between the first electrode 218 and the second electrode 219. The electrical circuit (not shown in FIG. 2) is described in more detail with reference to FIGS. 3 and 4. In this example, the first electrode array 212 is spaced from the second electrode array 214 laterally across the printing substrate 210 in a direction perpendicular to a direction of travel of the printing substrate 210 through the printing apparatus 200. The electrode arrays 212, 214 will be described further with reference to FIG. 4 below. The printing apparatus 200 further includes a guide member in the form of a guide roller 220 to bias the printing substrate 210 against the electrodes 218, 219 of the electrode arrays 212, 214. In this example, the guide roller 220 is a driven roller to transport the printing substrate 210 through the printing apparatus 200. The guide roller 220 is mechanically connected to a motor unit 222 to rotate the guide roller 220. In other examples, the guide roller 220 may instead be a non-driven component.

The electrode arrays 212, 214 may comprise more than two electrodes 218, 219 arranged in a line across the printing substrate in a direction perpendicular to a transport direction of the printing substrate through the printing apparatus 200.

Figure 3:
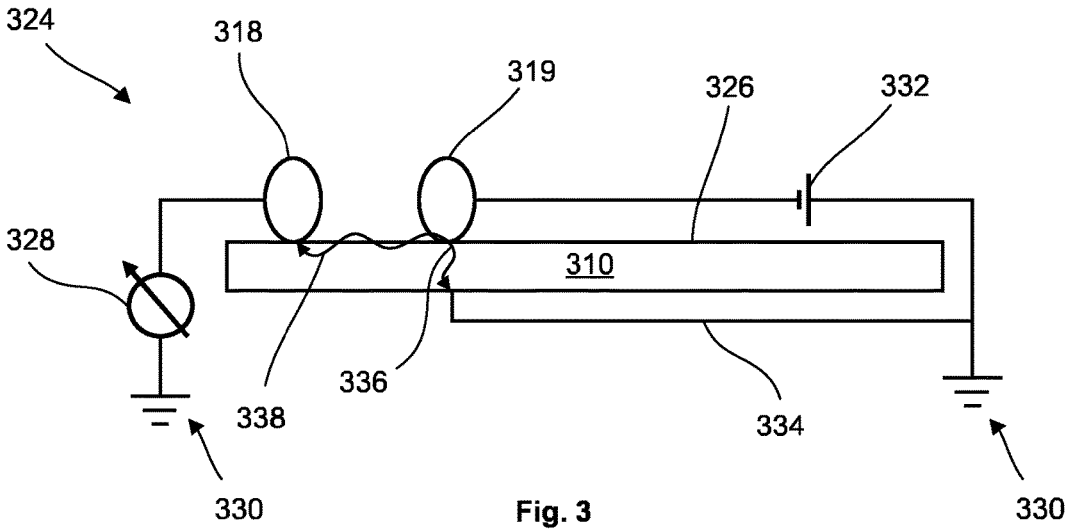
FIG. 3 is a schematic diagram illustrating an electrical circuit for use in an example printing apparatus according to the present disclosure.

FIG. 3 shows a schematic diagram illustrating an electrical circuit 324 for use in an example of printing apparatus according to the present disclosure. The apparatus includes the electrical circuit 324 for measuring the resistance of a region of a printing substrate 310 between a first electrode 318 and a second electrode 319 each in contact with a primed surface 326 of the printing substrate 310. Primer fluid is applied to the printing substrate 310 to provide the primed surface 326 which can be subsequently printed upon.

Due to the moisture content of the primer, the primer fluid has an electrical conductance. Conductance is inversely proportional to resistance, and, as such, the moisture content of the primer fluid may be generally inversely proportional to a resistance of the layer(s) of primer fluid on the printing substrate. Similarly, the dryness of the primer (i.e. the level of the absence of moisture content) may be generally proportional to the resistance of the primer fluid. Furthermore, an increase in a thickness of the layer(s) of primer fluid may result in an increase in the absolute moisture content of the layer(s) of primer fluid. In this way, the total thickness of the layer(s) of primer fluid may be generally inversely proportional to the resistance of the primer fluid.

To be sure that the measured resistance is associated with the resistance due to the primer fluid itself, and not the resistance associated with the underlying printing substrate 310, as is described in more detail below, the example apparatus may be arranged to generally measure the surface resistance of the primer fluid as applied to the printing substrate in a two-dimensional plane along the primed surface 326 of the printing substrate 310. Therefore, in the example apparatus, the resistance measured is indicative of the current flow along the plane of the primed surface 326 of the printing substrate 310, and the resistance effects of the printing substrate 310 on the current flow perpendicular to the plane of the primed surface may be discounted from the measured resistance signal.

As shown in FIG. 3, the surface resistance of the printing substrate 310 may be measured by the first electrode 318 and the second electrodes 319, each in contact with the primed surface 326 of the printing substrate 310. The electrodes 318, 319 are spaced laterally apart from one another, perpendicular with a direction of travel of the printing substrate 310 through the printing apparatus. The first electrode 318 is coupled to a resistance measurement unit 328 which in turn is coupled to ground 330. The resistance measurement unit 328 may output a signal indicative of the level of resistance in the current flow between the first electrode 318 and the second electrode 319. The second electrode 319 is coupled to a power supply 332 which in turn is coupled to ground 330. As indicated above, to avoid or reduce the impact of the resistance effects of the substrate itself on the current flow between the electrodes 318, 319, a ground electrode 334 is provided to contact a surface of the printing substrate 310 opposite the primed surface 326 adjacent to one or both of the electrodes 318, 319. The ground electrode 334 is coupled to ground 330. As the printing substrate 310 is coupled to ground 330 through the ground electrode 334, measurement of the resistance effects on the current flowing through the printing substrate 310 is avoided, because the ground electrode 334 receives any current 336 passing through the printing substrate 310 and conducts it to ground 330, bypassing it from the resistance measurement unit 328.

The power supply 332 acts as a current source, and conventional current 338 flows from the first electrode 318 (connected to the positive power terminal) to the second electrode 319 (connected to the negative power terminal) through the primed surface 326 of the printing substrate 310. The resistance measurement unit 328 measures a quantity indicative of the surface resistance of the primed surface 326 of the printing substrate 310 in the region between the two electrodes 318, 319. The current 338 flowing between the second electrode 319 and the first electrode 318 will vary dependent on the conductivity of the printing substrate 310 between the two electrodes. In examples, the surface resistance may be measured by placing an ohmmeter across the electrodes 318, 319 or an ammeter coupled to the first electrode 318 to measure the current flow between the first electrode 318 and ground 330. Alternatively any other kind of suitable measurement unit indicative of surface resistance may be used.

Thus, an output of the resistance measurement unit 328 may be used to determine a thickness of the layer(s) of primer fluid forming the primed surface 326 of the printing substrate 310 in the region between the first electrode 318 and the second electrode 319.

Figure 4:
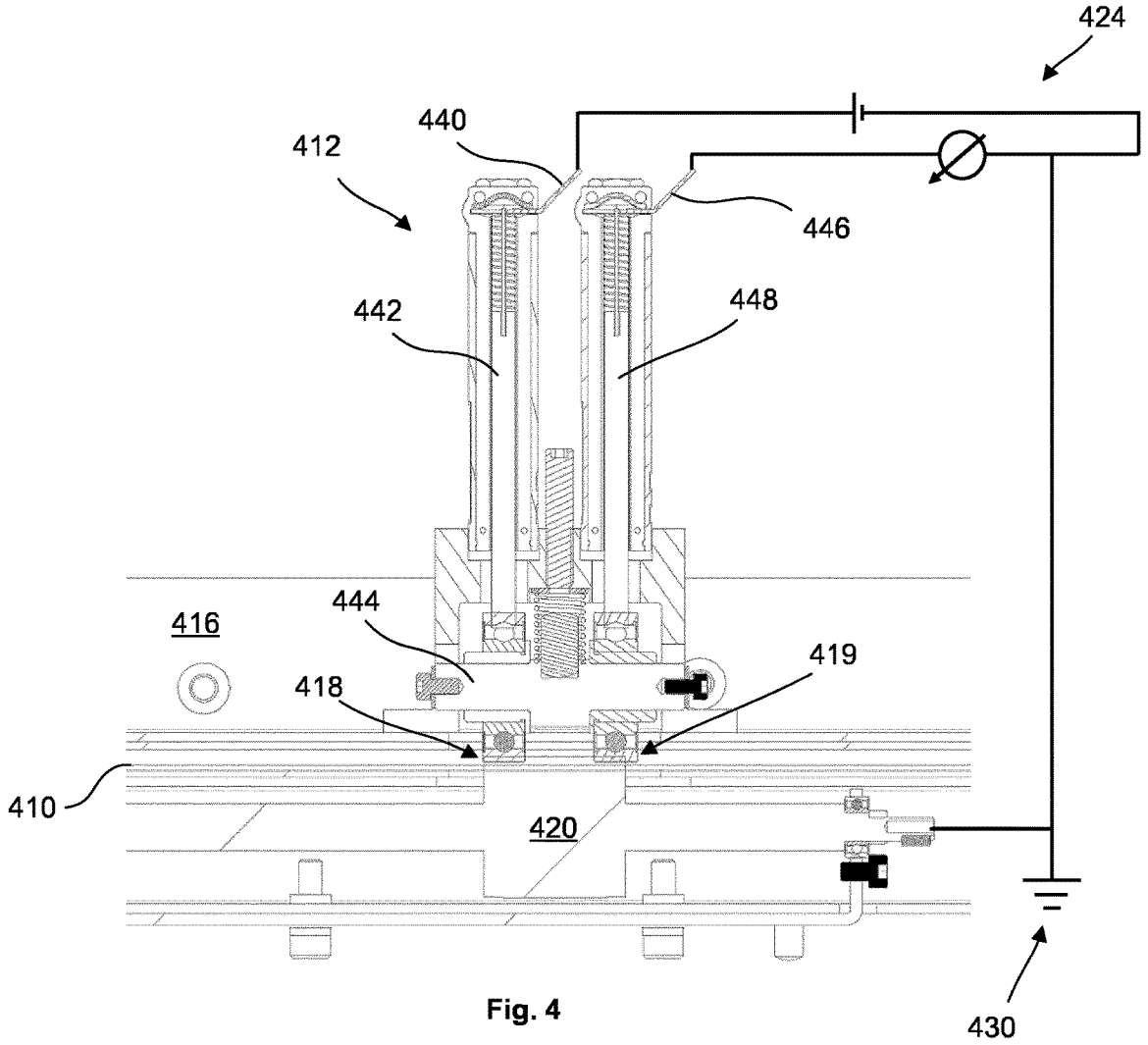
FIG. 4 is a diagram illustrating an example electrical circuit and electrode array in accordance with the present disclosure.

FIG. 4 is a diagram illustrating an electrical circuit and electrode array in accordance with the present disclosure. The electrical circuit 424 is substantially as described with reference to FIG. 3, and the electrode array 412 is substantially as described with reference to FIG. 2, with the ground 430 connected directly to the guide roller 420. The electrode array 412 comprises a first electrode 418 and a second electrode 419. The electrode array 412 includes a first contact 440 electrically coupled to the first electrode 418 via a first spring contact pin 442. In this example, the first electrode 418 is provided in the form of a ring surrounding a first portion of an electrode roller body 444. The electrode array 412 also includes a second contact 446 electrically coupled to the second electrode 419 via a second spring contact pin 448. Similarly, the second electrode 419 is provided in the form of a ring surrounding a second portion, spaced from the first portion, of the electrode roller body 444. Thus, the first electrode 418 and the second electrode 419 are provided as mutually electrically insulated members on a circumference of the electrode roller body 444. Thus, the electrodes 418, 419 and the guide roller 420 each rotate with the printing substrate 410 and may avoid any scuffing on the printing substrate by the electrodes 418, 419 to measure a surface resistance of the printing substrate 410 therebetween. The electrical circuit 424 may be controlled to continuously measure the surface resistance between the electrodes 418, 419.

Figure 5:
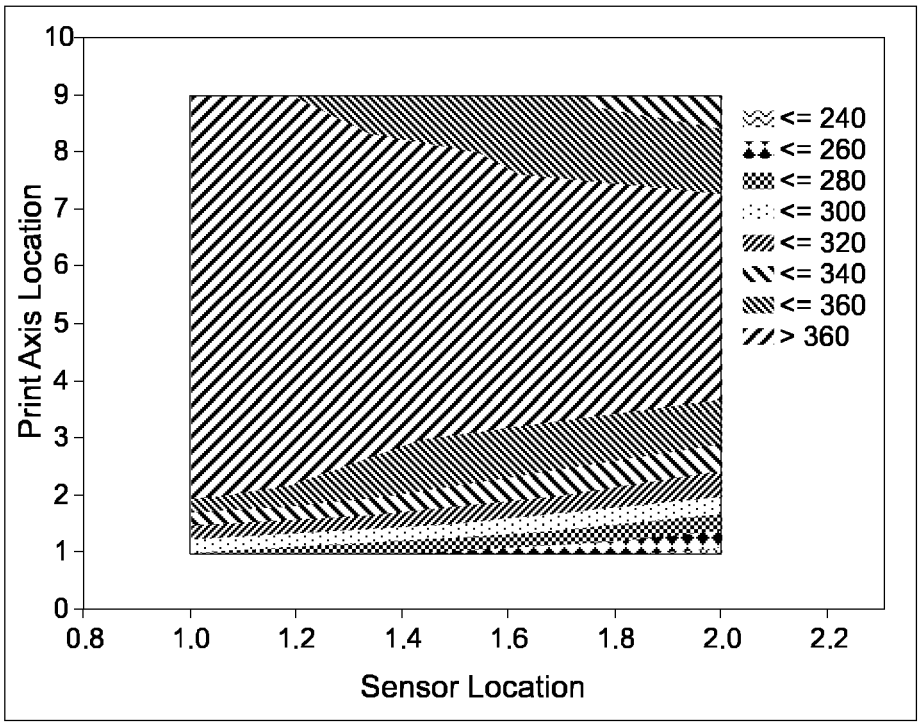
FIG. 5 is a graph showing a thickness map according to an example of the present disclosure.

FIG. 5 is a graph showing a thickness map according to an example of the present disclosure. The x-axis of the graph represents the location of a centre-point of a pair of electrodes forming an electrode array, as described previously. The sensor location of 1.0 represents the first electrode array, and the sensor location of 2.0 represents the second electrode array. Data points for locations between 1.0 and 2.0 have been determined by interpolation in this example. The y-axis of the graph represents the position in the direction of transport of the printing substrate, with 1 representing a first reading taken by the electrode arrays as a first end of the printing substrate enters the primer thickness determination module, and 9 representing a last reading taken by the electrode arrays as a second end, opposite the first end, of the printing substrate is about to exit the primer thickness determination module. Readings were taken by each electrode array at each of the positions 1 to 9 as the printing substrate passed through the primer thickness determination module. The units illustrated by the shaded patterns on the thickness map are indicative of a thickness of the layer(s) of primer fluid at that location on the printing substrate, though the values shown may not be equate to actual thickness values. Nevertheless, it may be observed that a central region of the printing substrate comprises a generally greater thickness of primer fluid than either the first end or the second end of the printing substrate. Furthermore, a left region of the printing substrate comprises a generally thicker layer of primer fluid that a right region of the printing substrate.

The thickness map may be provided as a graphical output as shown in FIG. 5, or instead as a data structure stored in a memory of the printing apparatus for subsequent display or otherwise. The thickness map may be determined based on an output of the resistance measurement unit included in the primer thickness determination module, as well as based on material properties of the printing substrate and the primer fluid. In examples, the thickness map may be determined based on the environmental conditions surrounding the printing substrate prior to measurement of the surface resistance by the primer thickness determination module.

In examples, the printing apparatus may be controlled to indicate to the user a deviation of the thickness of the primer fluid on the printing substrate from a predetermined acceptable thickness. In an example, the printing apparatus may be controlled to indicate to the user a deviation of the thickness of the primer fluid on the printing substrate from an average thickness by a predetermined threshold deviation. In some examples, the printing apparatus may be controlled to adjust an amount of primer fluid applied in one or more regions of the printing substrate to modify a future thickness of the layer(s) of primer fluid on the printing substrate. In an example, the printing apparatus may be controlled to determine and output an index of coating thickness uniformity based on an output (or a plurality of outputs) from the primer thickness determination module.

Figure 6:
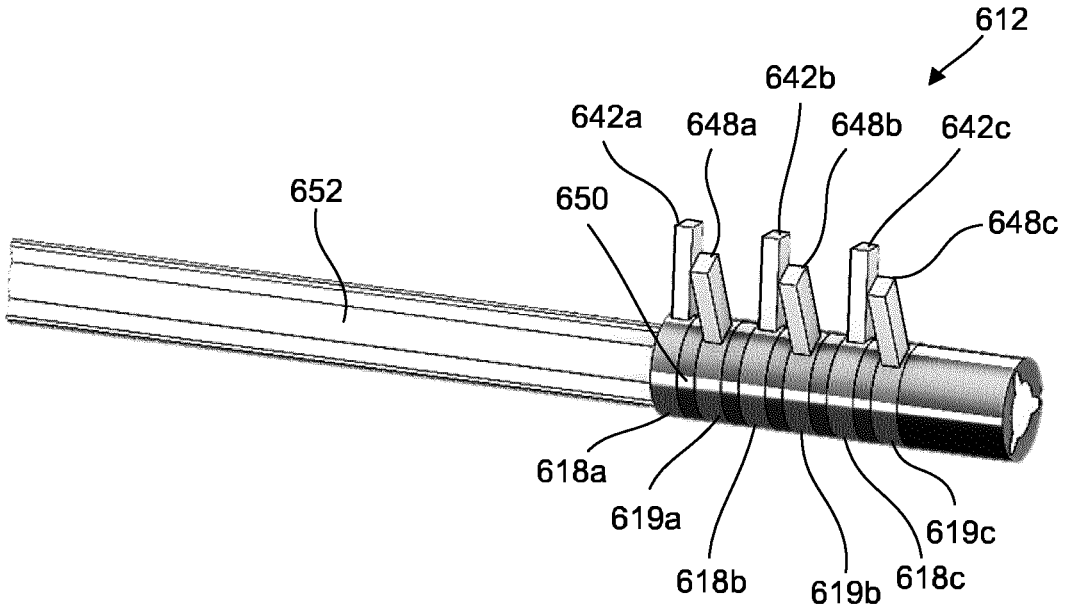
FIG. 6 is a diagram showing electrodes according to an example of the present disclosure.

FIG. 6 is a diagram showing electrodes according to an example of the present disclosure. The electrode array 612 shown in FIG. 6 comprises a total of six electrodes 618*a*, 618*b*, 618*c*, 619*a*, 619*b*, 619*c*. Each electrode 618*a*, 618*b*, 618*c*, 619*a*, 619*b*, 619*c* is separated from further electrodes 618*a*, 618*b*, 618*c*, 619*a*, 619*b*, 619*c* by insulating disks 650 (only one labelled). The electrodes 618*a*, 618*b*, 618*c*, 619*a*, 619*b*, 619*c* and insulating disks 650 are provided on a spindle 652. In examples, an outer diameter of the insulating disks 650 may be less than an outer diameter of the electrodes 618*a*, 618*b*, 618*c*, 619*a*, 619*b*, 619*c*. The electrodes 618*a*, 618*b*, 618*c*, 619*a*, 619*b*, 619*c* and spindle 652 are substantially as described in relation to the electrode roller 444 shown in FIG. 4, and are to rotate in contact with the printing substrate whereby to maintain electrical contact between the electrodes 618*a*, 618*b*, 618*c*, 619*a*, 619*b*, 619*c* and the printing substrate. As also described in relation to FIG. 4, spring contact pins 642*a*, 642*b*, 642*c*, 648*a*, 648*b*, 648*c* are also provided to contact each of the electrodes 618*a*, 618*b*, 618*c*, 619*a*, 619*b*, 619*c*. The spring contact pins 642*a*, 642*b*, 642*c* connected to the first electrodes 618*a*, 618*b*, 618*c* are rotationally offset from the spring contact pins 648*a*, 648*b*, 648*c* connected to the second electrodes 619*a*, 619*b*, 619*c* to allow simple electrical connection to be made between the spring contact pins 642*a*, 642*b*, 642*c*, 648*a*, 648*b*, 648*c* and the other components in the electrical circuit to determine the surface resistance on the printing substrate. The spring contact pins 642*a*, 642*b*, 642*c*, 648*a*, 648*b*, 648*c* do not typically rotate with the electrodes 618*a*, 618*b*, 618*c*, 619*a*, 619*b*, 619*c*.

Although the example shown in FIG. 6 comprises six electrodes, examples may be contemplated having fewer, or more electrodes. In an example, the electrode array may comprise over 20 electrodes.

Figure 7:
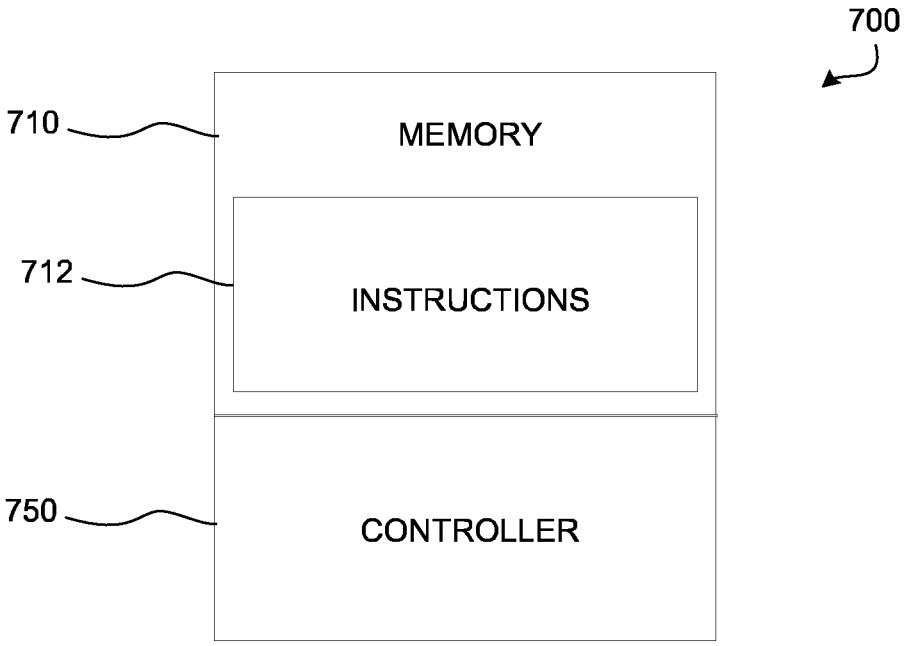
FIG. 7 is a simplified diagram of an example controller of printing apparatus according to the present disclosure.

FIG. 7 is a simplified diagram of a printing apparatus according to the present disclosure. The apparatus 700 comprises a controller 750 that controls the general operation of the printing apparatus 700. In the example shown in FIG. 7 the controller 750 is a microprocessor-based controller that is coupled to a memory 710, for example via a communications bus (not shown). The memory stores processor executable instructions 712. The controller 750 may execute the instructions 712 and hence control operation of the printing apparatus 700 in accordance with those instructions.

In one example, the controller 750 controls the primer thickness determination module 208 to determine the thickness of the primer fluid as described hereinbefore.

Figure 8:
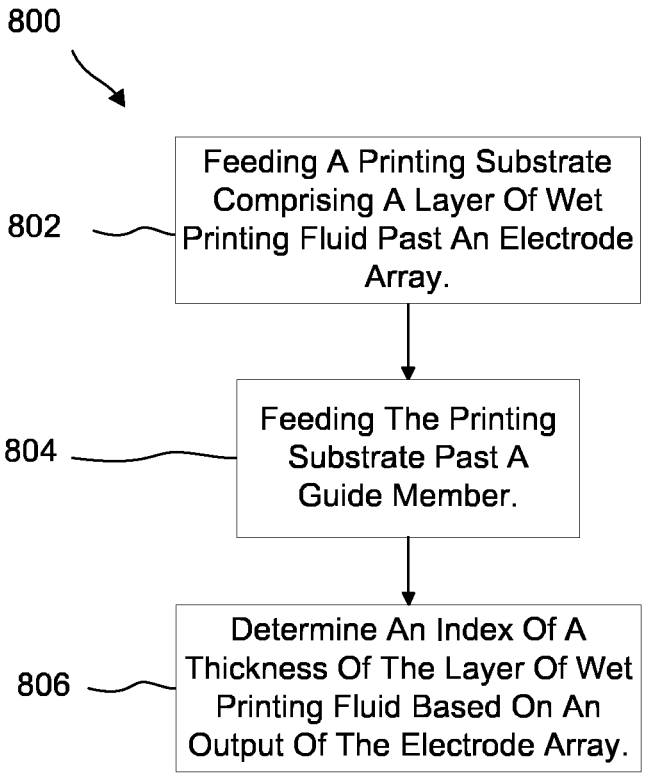
FIG. 8 is a flowchart showing an example method of operating printing apparatus according to the present disclosure.

FIG. 8 is a flowchart showing a method of operating printing apparatus according to the present disclosure. In the method 800 of FIG. 8, at 802, a printing substrate is fed past an electrode array. The printing substrate comprises a layer of wet printing fluid, such as primer fluid. The electrode array comprises a plurality of electrodes to contact a surface of the printing substrate. At 804, the printing substrate is fed past a guide member to bias the printing substrate against the plurality of electrodes. In examples, the printing substrate is fed past the guide member and the electrode array at substantially the same point on the printing substrate. At 806, an index of a thickness of the layer of wet printing fluid, such as primer fluid, is determined based on an output of the electrode array.

It will be appreciated that examples described herein can be realised in the form of hardware, or a combination of hardware and software. Any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are examples of machine-readable storage that are suitable for storing a program or programs that, when executed, implement examples described herein. Accordingly, examples provide a program comprising code for implementing a system or method as described herein and a machine readable storage storing such a program.

Throughout the description and claims of this specification, the words "comprise" and "contain" and variations of them mean "including but not limited to", and they are not intended to (and do not) exclude other components, integers or steps. Throughout the description and claims of this specification, the singular encompasses the plural unless the context otherwise requires. In particular, where the indefinite article is used, the specification contemplates plurality as well as singularity, unless the context requires otherwise.

Features, integers or characteristics described in conjunction with a particular aspect or example described herein are applicable to any other aspect or example described herein unless incompatible therewith. All of the features disclosed in this specification (including any accompanying claims, abstract and drawings), and/or all of the actions of any method or process so disclosed, may be combined in any combination, except combinations where at least some of such features and/or actions are mutually exclusive. The disclosure is not restricted to the details of any foregoing examples. The disclosure extends to any novel one, or any novel combination, of the features disclosed in this specification (including any accompanying claims, abstract and drawings), or to any novel one, or any novel combination, of the actions of any method or process so disclosed.

The invention claimed is:

1. A printing apparatus comprising:

an electrode array comprising a plurality of electrodes;

a guide member to bias, in use, a printing substrate comprising a layer of printing fluid, towards the plurality of electrodes; and processing circuitry to determine a dryness of the layer of printing fluid based on an output of the electrode array when the plurality of electrodes is in electrical contact with the printing substrate.

2. The printing apparatus of claim 1, wherein the electrode array extends in a first direction along a surface of the printing substrate and substantially perpendicular to a travel direction of the printing substrate.

3. The printing apparatus of claim 2, wherein the electrode array comprises a plurality of insulators each insulator spacing adjacent electrodes.

4. The printing apparatus of claim 1, wherein the guide member is positioned on an opposite side of the printing substrate from the electrode array to bias the printing substrate toward the electrode array and wherein, in use, the printing substrate passes between the guide member and the electrode array.

5. The printing apparatus of claim 1, wherein the guide member comprises a roller to contact the printing substrate.

6. The printing apparatus of claim 1, further comprising a dryer, wherein the processing circuitry is to increase drying if the determined dryness is below an acceptable level.

7. The printing apparatus of claim 1, further comprising a dryer, wherein the processing circuitry is to decrease drying if the determined dryness is above an acceptable level.

8. The printing apparatus of claim 1, comprising a printing fluid applicator to apply printing fluid to the printing substrate at a position upstream of the electrode array.

9. The printing apparatus of claim 1, wherein each electrode comprises a roller to electrically contact, in use, the layer of printing fluid on the printing substrate.

10. A method of operating a printing apparatus comprising:

feeding a printing substrate comprising a layer of wet printing fluid, the printing substrate being fed between:

an electrode array comprising a plurality of electrodes contacting the layer of wet printing fluid; and a guide member biasing the printing substrate towards the plurality of electrodes; and determining moisture content of the layer of wet printing fluid based on an output of the electrode array when the plurality of electrodes is in electrical contact with the printing substrate.

11. The method of claim 10, comprising:

determining if the moisture content of the layer of wet printing fluid is outside a predetermined acceptable range; and controlling a dryer to operate if the moisture content is outside the predetermined acceptable range.

12. A printing apparatus comprising:

an electrode array comprising a plurality of electrodes configured to contact a layer of wet printing fluid of a printing substrate, the electrode array extending in a first direction along a surface of the printing substrate and substantially perpendicular to a travel direction of the printing substrate; and processing circuitry configured to determine an index of a thickness of the layer of wet printing fluid based on an output of the electrode array when the plurality of electrodes is in electrical contact with the printing substrate, and to determine a thickness map comprising datapoints in the first direction, and further comprising datapoints in the travel direction as the printing substrate is moved past the plurality of electrodes, wherein each datapoint is an index of the thickness of the layer of wet printing fluid at a predetermined location on the printing substrate.

13. The printing apparatus of claim 12, comprising a printing fluid applicator to apply printing fluid to the printing substrate at a position away from the electrode array in a direction opposite to a travel direction of the printing substrate.

14. The printing apparatus of claim 13, wherein the printing fluid applicator is controlled to change an amount of printing fluid to be applied to the printing substrate based on the determined index of the thickness.

15. The printing apparatus of claim 14, further comprising a dryer;

wherein the processing circuitry is further configured to determine a moisture content of the layer of wet printing fluid based on an output of the electrode array when the plurality of electrodes is in electrical contact with the printing substrate; and wherein, if the moisture content of the layer of wet printing fluid is outside a predetermined acceptable range, drying by the dryer is adjusted based on the output of the electrode array when the plurality of electrodes is in electrical contact with the printing substrate.

* * * * *